United States Patent [19]

Norden, Jr.

[11] Patent Number: 4,796,445

[45] Date of Patent: Jan. 10, 1989

[54] DOOR LOCKING MECHANISM

[76] Inventor: Howard P. Norden, Jr., 3 Crest Hill Pl., Smithtown, N.Y. 11787

[21] Appl. No.: 941,597

[22] Filed: Dec. 15, 1986

[51] Int. Cl.[4] ..... E05B 65/10

[52] U.S. Cl. ..... 70/94; 70/135; 292/205; 292/104; 292/259 R

[58] Field of Search ..... 70/94, 91, 95, 135; 292/259, 262, 285, DIG. 49, 54, 338, 339, 44, 205, 104

[56] References Cited

U.S. PATENT DOCUMENTS

| | | | |
|---|---|---|---|
| 1,448,554 | 3/1923 | Ludemann | 70/135 |
| 2,130,216 | 9/1938 | Zaninovich | 292/104 X |
| 2,408,731 | 10/1946 | Burger | 292/205 X |
| 2,626,171 | 1/1953 | Wallace | 292/104 X |
| 2,703,248 | 3/1955 | Mauer | 292/104 X |
| 3,510,162 | 5/1970 | Smith et al. | 292/104 X |
| 3,527,069 | 9/1970 | Tumbiolo | 292/205 X |
| 3,656,788 | 4/1972 | Emery | 292/259 R X |
| 3,724,130 | 4/1973 | Bogue | 292/259 X |
| 3,792,885 | 2/1974 | Giardina et al. | 292/259 X |
| 3,806,179 | 4/1974 | Roessle | 292/259 |
| 3,821,884 | 7/1974 | Walsh | 292/259 X |
| 4,057,274 | 11/1977 | Van Gompel | 292/259 R |
| 4,082,332 | 4/1978 | Palmer | 292/259 R |
| 4,135,376 | 1/1979 | Evans et al. | 70/94 X |
| 4,262,503 | 4/1981 | Kuebler | 292/259 R X |
| 4,270,311 | 6/1981 | Palomar | 292/54 X |
| 4,286,809 | 9/1981 | Godwin | 292/54 |
| 4,295,676 | 10/1981 | Smith | 292/262 |
| 4,372,136 | 2/1983 | Mickelson | 70/91 X |
| 4,372,138 | 2/1983 | De Forrest | 70/56 |
| 4,397,499 | 8/1983 | Werk et al. | 292/259 R X |
| 4,413,852 | 11/1983 | Burnell et al. | 292/259 R |
| 4,581,907 | 4/1986 | Eberly | 292/205 X |
| 4,639,023 | 1/1987 | Boisvert | 70/94 X |
| 4,669,767 | 6/1987 | Leto | 70/94 X |

FOREIGN PATENT DOCUMENTS

| | | | |
|---|---|---|---|
| 636765 | 4/1928 | France | 292/54 |

*Primary Examiner*—Robert L. Wolfe
*Assistant Examiner*—Suzanne L. Dino
*Attorney, Agent, or Firm*—Leonard Belkin

[57] ABSTRACT

A door locking mechanism for use with an outwardly swinging door comprising a bar permanently mounted on the inside of the door spanning the width. At each end of the bar is mounted a locking member in the form of a plate which is rotatable between a first position blocking the door against opening and a second position releasing the door. Padlocks may be employed to lock the plates in either position.

6 Claims, 2 Drawing Sheets

DOOR LOCKING MECHANISM

BACKGROUND OF THE INVENTION

This invention relates to a door locking mechanism and more particularly to a door locking mechanism for mounting on the inside of a door which is capable of being locked in either the open or closed position.

Commercial establishments, especially where large numbers of persons may congregate, usually must be provided with outswinging exit doors to facilitate the egress of persons during a fire or other emergency. Quite often, these doors are provided with burglar bars to prevent unauthorized entry from the outside when the premises are vacant. Thus, the bar must be removed in accordance with fire regulations when the premises are in use and put back in place at other times. In such an arrangement the bar must be stored when not in use, and can be misplaced, lost, or even stolen in some cases.

A variety of burglar bar arrangements are shown in various United States Patents.

U.S. Pat. No. 3,819,216 to Richardson shows a burglar bar of the type which must be removed to use the door. In U.S. Pat. No. 3,908,328 to Pearson, there is a bar attached to the door opening rather than the door itself and is designed to secure the door knob. U.S. Pat. No. 4,270,311 to Palomar discloses an escape hatch with a pair of latch assemblies at opposite ends of the latch. U.S. Pat. No. 4,529,235 to Florentine has a door bolting device designed for use with a door shut for a prolonged period.

All of the patent devices described above are awkward to use, complex in construction, or are otherwise unsatisfactory for use under the conditions described.

SUMMARY OF THE INVENTION

The present invention is designed to avoid or overcome many of the problems associated with burglar bars or other door locking mechanisms in use up to now with exit doors which must be free for use in an emergency.

In accordance with a preferred embodiment of this invention there is provided a door locking mechanism for use on the inside of an outswinging door comprising a bar permanently mounted on said door spanning substantially the full width of the latter. At each end of the bar there is mounted a locking member which rotates between a first position blocking the door against movement and a second position releasing the door for movement. Provision is made to permit the locking members to be locked in either position to insure that the locking members are not deliberately or inadvertently moved into positions which are not appropriate.

It is thus a principle object of this invention to provide a door locking mechanism capable of being mounted permanently in place and insuring that the door is maintained either in a secured state or in condition to be freely opened during an emergency Other objects and advantages of this invention will hereinafter become obvious from the following description of a preferred embodiment of this invention.

DETAILED DESCRIPTION OF THE PREFERRED EMBODIMENT

Figure 1:
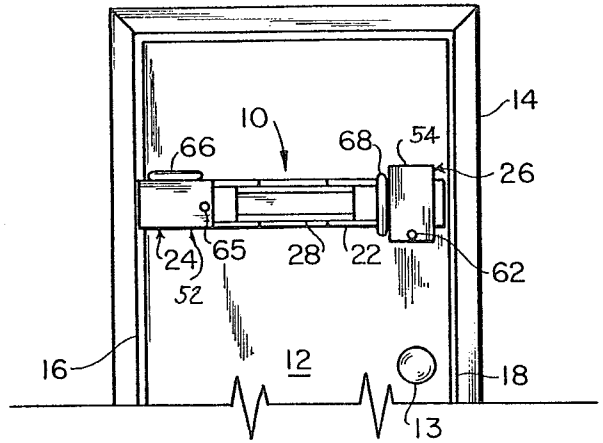
FIG. 1 is a front, elevational view showing a preferred embodiment of the door locking mechanism of the present invention operatively installed on the inside of an outswinging door.

Referring to FIG. 1, there is illustrated a door locking mechanism 10 incorporating the principles of this invention mounted on the inside of an outswinging door 12 with a conventional door knob 13 hung in conventional fashion over the opening formed by a door frame 14. Frame 14 may be provided with a pair of opposed, upstanding door stops 16 and 18 which are connected to frame 14 along the inside vertical marginal edges between door 12 and frame 14. This construction is typical for doors of this type.

Door locking mechanism 10 spans substantially the entire width of door 12, and consists of an expansible bar assembly 22 mounted permanently on door 12 in a manner to be described later and a pair of pivotal members 24 and 26 at opposite ends of bar assembly 22. The left end of mechanism 10 is shown, for convenience, in its locked position, whereas the right end is shown in its unlocked position.

Figure 2:
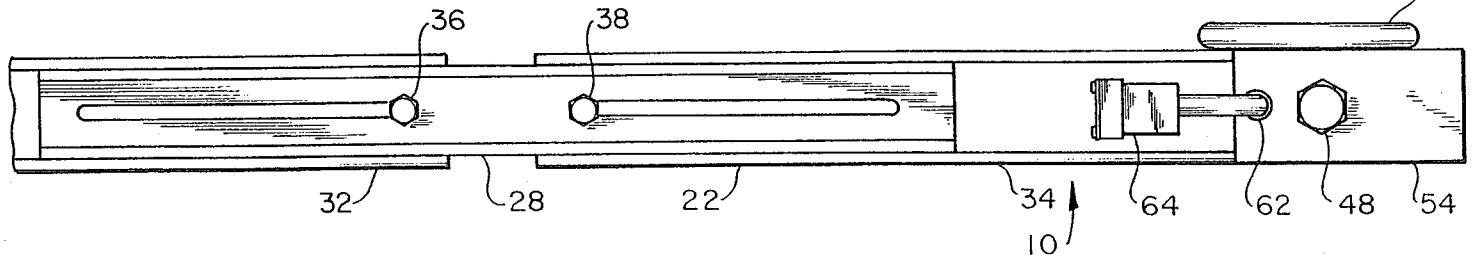
FIG. 2 is a fragmentary plan view of the bar assembly in the locked position.
Figure 3:
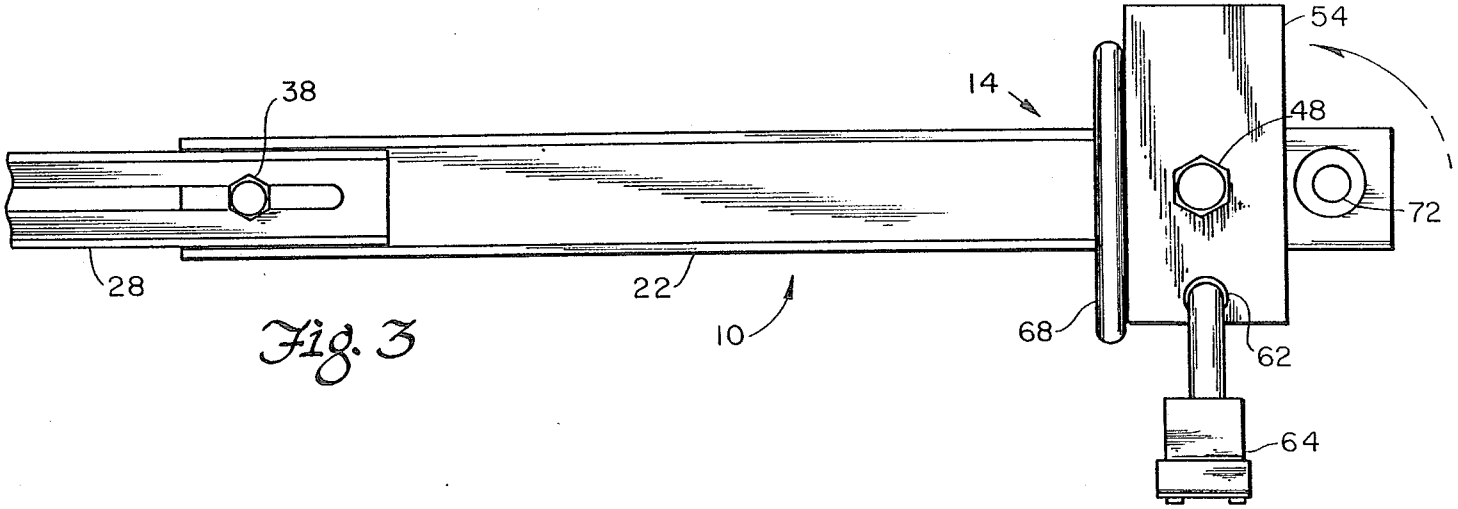
FIG. 3 is a fragmentary plan view of the bar assembly in the unlocked position.
Figure 4:
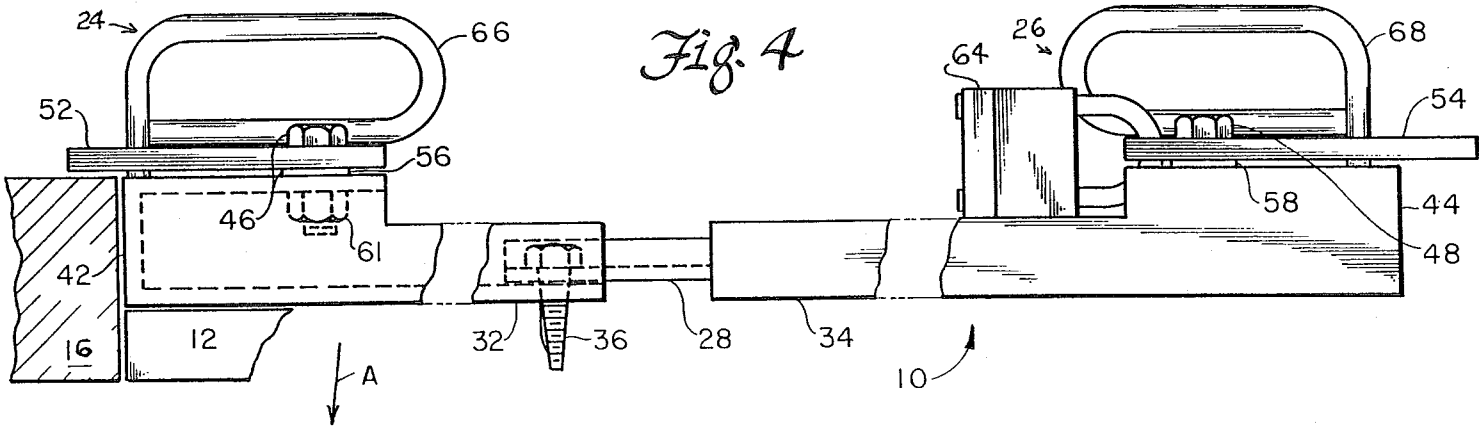
FIG. 4 is a fragmentary view looking down on a door having the door locking mechanism in its locked position.

For details of mechanism 10, reference is made to FIGS. 2, 3, and 4.

Bar assembly 22 is an extensible unit consisting of a slotted channel 28 riding in a pair of channels 32 and 34. By adjusting the positions of channels 32 and 34 on channel 28 and bolting them to the door using a pair of screws 36 and 38, mechanism 10 can be adjusted to any size door. Once mounted securely in place by screws 36 and 38, mechanism 10 remains and is not removed once in use.

As best seen in FIG. 4, the far ends of channels 32 and 34 terminate in raised, hollow boxes 42 and 44, respectively. The top surface of each of boxes 42 and 44 is provided with a bolt 46 and 48, respectively, acting as a shaft to accomodate a pivotable plate 52 and 54, respectively, making up pivotal members 24 and 26, respectively. A washer 56 between plate 52 and the top surface of box 42 insures easy rotation of plate 52. A similar washer 58 is provided for plate 54. A nut 61 holds bolt 46 in place while a similar nut (not shown) holds bolt 48 in place. In FIG. 4, plates 52 and 54 are shown in position blocking the outward movement of door 23 indicated by arrow A.

As seen in FIG. 2, plate 54 is provided with a hole 62 to accomodate a padlock 64 to prevent rotation of plate 54, thereby effectively locking the latter in its locked position. Padlock 64 sits inside of channel 34 and its movement is blocked by the side walls of the channel. Plate 52 on an opposite end of mechanism 10 is similarly provided with a hold 65 for a padlock (not shown), as seen in FIG. 1. In addition, each plate 52 and 54 is provided with a handle 66 and 68, respectively, welded or otherwise attached to its respective plate and extending out as illustrated. Handles 66 and 68 are grasped in order to effect the rotation of its respective plate.

As seen in FIG. 3, hole 62 in plate 54 makes it possible to lock the latter in its open position also, using padlock 64, a side wall of channel 22 preventing rotation of plate 52 into the closed position. An end attachment hole 72 in the bottom of box 44 and one (not shown) in box 42 may be provided in case additional bolting to the door at the ends of mechanism 10 is required.

In the use of door locking mechanism 10, its length is adjusted as described above to the width of door 12 and then bolted permanently in place. When door 12 is to be locked against swinging out, plates 52 and 54 are rotated to their positions shown in FIG. 4 and padlocks inserted in holes 65 and 62, if desired, to prevent inadvertent or deliberate movement of the plates to their open positions.

When it is desired to unlock door 12 to permit it to be opened, the padlocks are removed, plates 52 and 54 rotated to the position shown for plate 54 in FIGS. 1 and 3, and the padlocks can be remounted to insure that they remain in the open position.

In the arrangement described, it is seen that the door locking mechanism remains permanently mounted on the door so that it can not be mislaid, lost, or stolen. In addition, the mechanism can be easily and conveniently adjusted to release or lock the door, and in addition, the mechanism can be locked in either position.

The design is seen to be simple, economic in construction, reliable, and easy to use. It meets all known regulations dealing with exit doors in public places where easy egress in time of an emergency is required.

While only a preferred embodiment of this invention has been described, it is understood that many variations and changes are possible without departing from the principles of this invention as defined in the claims which follow.

What is claimed is:

1. An emergency exit door locking mechanism for use on the inside of an outswinging door mounted in the opening of a frame comprising a door mounted in said frame for swinging outwardly to open, stationary bar means permanently mounted on the inside of and spanning substantially the whole width of said door, position means for selectively preventing said door from being opened or being blocked when required as an exit comprising independently operable blocking means mounted at each end of said bar means each movable between a first positive blocking said door against swinging outwardly from said frame and a second position permitting said door to swing outwardly, and each said blocking means comprising a plate for pivoting on each end of said bar means and having means on said movable blocking means for padlocking said blocking means in either of the aforesaid first and second positions so as to prevent said door from being opened or preventing said door from being blocked when required as an exit, respectively.

2. The door locking mechanism of claim 1 in which said bar means comprises a pair of channel members extensibly mounted outwardly from the opposite ends of a central channel member.

3. The door locking mechanism of claim 2 in which each of the ends of said bar means adjacent said frame forms a hollow box to support on one surface thereof said plate.

4. The door locking mechanism of claim 3 in which said bar means is formed from channels, each padlock receiving means on each plate consisting of an opening through which a portion of a padlock may pass, rotation of each plate being prevented by the side walls of said channels.

5. The door locking mechanism of claim 2 in which each of said channel members forms a box at each of the opposite ends of said mechanism forming a surface on which each said plate is mounted, said padlock when employed to lock its plate against rotation being adjacent a side wall of its channel to prevent said rotation.

6. The door locking mechanism of claim 1 in which each said blocking means is provided with handle means to facilitate manual movement of said blocking means.

* * * * *